US007789521B2

(12) United States Patent
Li

(10) Patent No.: US 7,789,521 B2
(45) Date of Patent: Sep. 7, 2010

(54) ORNAMENTAL LIGHT

(76) Inventor: Xuliang Li, Hengjiangxia Village, Changping Town, Kingsun Group Co. Ltd., Dongguan, Guangdong (CN)

( * ) Notice: Subject to any disclaimer, the term of this patent is extended or adjusted under 35 U.S.C. 154(b) by 121 days.

(21) Appl. No.: 11/759,434

(22) Filed: Jun. 7, 2007

(65) Prior Publication Data

US 2008/0089065 A1 Apr. 17, 2008

(30) Foreign Application Priority Data

Oct. 11, 2006 (CN) ..... 2006 2 0015209 U

(51) Int. Cl.
*F21S 6/00* (2006.01)

(52) U.S. Cl. ..... 362/121; 362/122; 362/244; 362/246; 362/565; 362/566; 362/568; 362/627; 362/653; 428/105; 428/113; 428/114; 428/116; 428/119

(58) Field of Classification Search ..... 362/121, 362/244, 246, 252, 329, 489, 565, 566, 568, 362/618, 627, 653, 122, 124, 807–812; 428/105, 428/113, 114, 116, 119
See application file for complete search history.

(56) References Cited

U.S. PATENT DOCUMENTS 3,904,866 A * 9/1975 Hayes ..... 362/615
6,683,717 B1 * 1/2004 Miyatake et al. ..... 359/490
2003/0012019 A1 * 1/2003 Pan ..... 362/231
2004/0100797 A1 * 5/2004 Yang ..... 362/252
2005/0111085 A1 * 5/2005 Kato ..... 359/366
2007/0127259 A1 * 6/2007 Lin ..... 362/565
2008/0151569 A1 * 6/2008 Wang ..... 362/551

* cited by examiner

*Primary Examiner*—Sandra L O'Shea
*Assistant Examiner*—Mary Zettl
(74) *Attorney, Agent, or Firm*—Global IP Services; Tianhua Gu

(57) ABSTRACT

The invention relates to an ornamental light and, more particularly, relates to an ornamental light with polychrome effect. The ornamental light includes at least one illuminant, a support frame with special shape and a film covered on the surface of the support frame. The film includes a transparent base plate and two polychrome films. Each of the polychrome film is stuck to each side of the base plate respectively. The venations of the two polychrome films are perpendicular to each other. The invention provides an ornamental light which can present different polychrome display effect, enough imagination and aesthetic feeling when viewed from different angles.

8 Claims, 4 Drawing Sheets

B

B

ORNAMENTAL LIGHT

CROSS REFERENCE TO THE RELATED PATENT APPLICATION

This application claims the priority of the Chinese patent application No. 200620015209.6, filing date of Oct. 11, 2006.

FIELD OF THE INVENTION

The invention relates to an ornamental light and, more particularly, to an ornamental light with polychrome effect.

BACKGROUND OF THE INVENTION

Ornamental light is frequently used in our daily life especially on festivals. A conventional ornamental light includes a support bracket with a cavity defined therein. An illuminant is accommodated in the cavity or fastened to the support bracket. And then, a layer of color gauze, glass or polyvinyl chloride (PVC) film is covered on the outside of the support bracket. An exemplary ornamental light is disclosed in, for example, Chinese Patent No. 200520008743.X. The ornamental light includes an iron frame, an illuminant and a conductive wire connecting the illuminant and a power supply. The illuminant is fixed on the iron frame. A transparent PVC film, which is formed by suction molding, covers the external surface of the iron frame. The conventional ornamental light, including the ornamental light disclosed in Chinese Patent No. 200520008743.X, displays mono color or pattern, and makes it seem monotone, without imagination and aesthetic feeling.

SUMMARY OF THE INVENTION

A main object of the invention is to provide an ornamental light, which overcomes the drawbacks of the conventional technology, shows different polychrome effect when viewed from different angles, and presents more imagination and brings more aesthetic feeling.

To achieve above object, the invention provides an ornamental light which comprises at least one illuminant, a support frame with a special shape and a film covered on the surface of the support frame. The film comprises a transparent base plate and two polychrome films. Each of the polychrome film is stuck to each side of the base plate respectively.

Each of the polychrome film has a plurality of venations defined therein in a parallel manner, and the venations of one polychrome film disposed on one side of the base plate are in cross with those of the other polychrome film disposed on the other side of the base plate.

The venations of one polychrome film disposed on one side of the base plate may be perpendicular to those of the other polychrome film disposed on the other side of the base plate. The base plate is a colorless and transparent base plate. The shape of the support frame may be selected from cylinder, ball, triangular prism, cuboid, pentagonal prism, hexagonal prism, octagonal prism, decagonal prism, dodecagonal prism or an animal, or may be selected from rat, cow, tiger, rabbit, dragon, snake, horse, sheep, monkey, chicken, dog, pig, deer, bird, fish, duck, goose, elephant, lion, tree and banana.

The support frame may be disposed to surround the illuminants which are located in a cavity of the support frame. The illuminants may be mounted on the support frame. The shape of the entire illuminants is the same as that of the support frame. The polychrome films may have multicolor paint coated thereon.

A layer of special film is provided to cover the outside of the support frame of the ornamental light. The film includes a transparent base plate and two polychrome films attached to each side of the base plate respectively. When the beam of the illuminants refracts from the cavity of the support frame through the polychrome films, viewed from different angles, polychrome effect will be shown. The ornamental light will have different polychrome display effect, enough imagination and aesthetic feeling, especially when the venations of the two polychrome film is perpendicular to each other.

DETAILED DESCRIPTION OF ILLUSTRATED EMBODIMENTS

Figure 1:
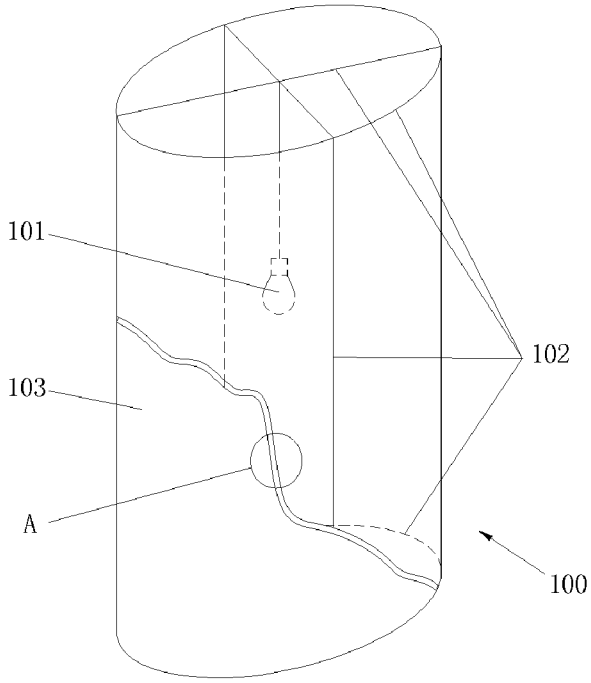
FIG. 1 is a schematic view of a first embodiment of the present invention.
Figure 2:
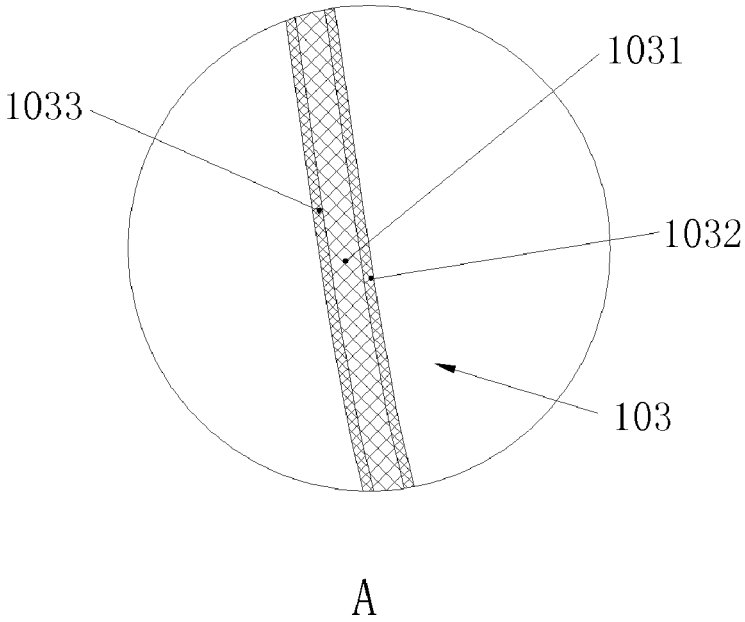
FIG. 2 is a partially enlarged view of portion A of FIG. 1.

FIGS. 1-2 illustrate a first exemplary embodiment of the present invention.

An ornamental light 100 includes a bulb 101, a cylinder-shaped support frame 102 and a film 103 which covers the circumferential surface of the support frame 102. Referring to FIG. 1, the support frame 102 is of a cylinder shape. The support frame 102 surrounds the bulb 101, and the bulb 101 is located in a cavity defined by the cylinder-shape of the support frame 102. Referring to FIG. 2, the film 103 includes a transparent base plate 1031 and two polychrome films 1032, 1033. Each of the polychrome film 1032, 1033 is attached to each side of the base plate 1031 respectively. The base plate 1031 is a light-red transparent plastic film. Each of the polychrome films 1032, 1033 has a plurality of venations in a parallel manner. The angle formed between the venations of the polychrome film 1033 disposed on one side of the base plate 1031 and the venations of the polychrome film 1032 disposed on the other side of the base plate 1031 is 60°.

According to the embodiment of the present invention, a layer of special film is provided to cover the outside of the cylinder-shaped support frame of the ornamental light. The film includes a light-red transparent base plate and two polychrome films. Each of the polychrome film is attached to each side of the base plate respectively. The venations of the two polychrome films are in cross with each other. Polychrome effect will be shown when the beam of the bulb refracts from the cavity of the support frame through the polychrome films. Since the angle between the venations of the polychrome film disposed on one side of the base plate and the venations of the polychrome film disposed on the other side of the base plate is 60°, the ornamental light will have different polychrome display effect, and enough imagination and aesthetic feeling when viewed from different angles.

Figure 3:
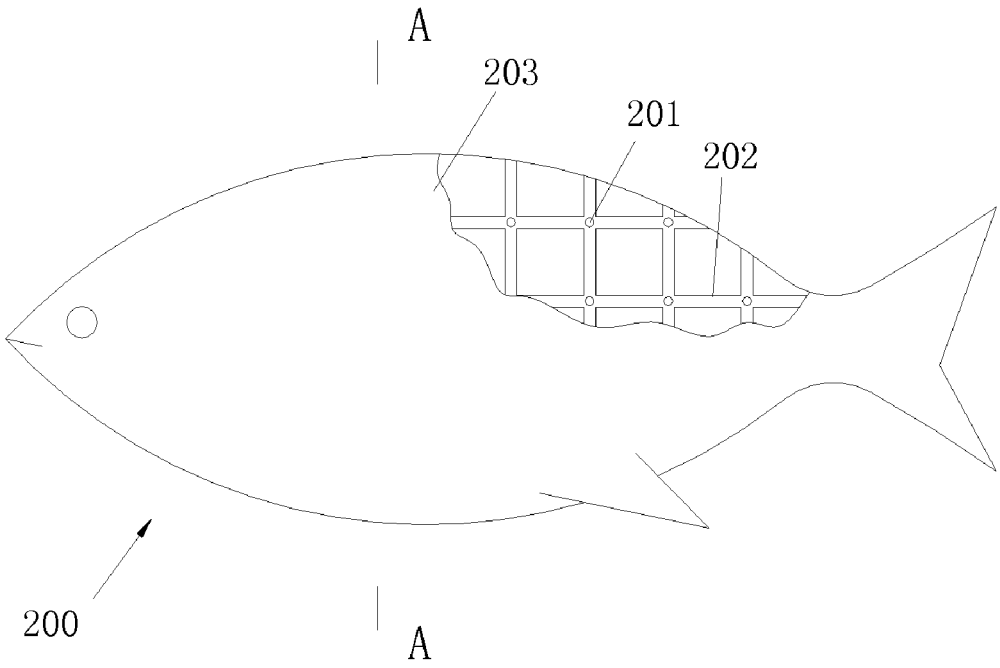
FIG. 3 is a schematic view of a second embodiment of the present invention.
Figure 4:
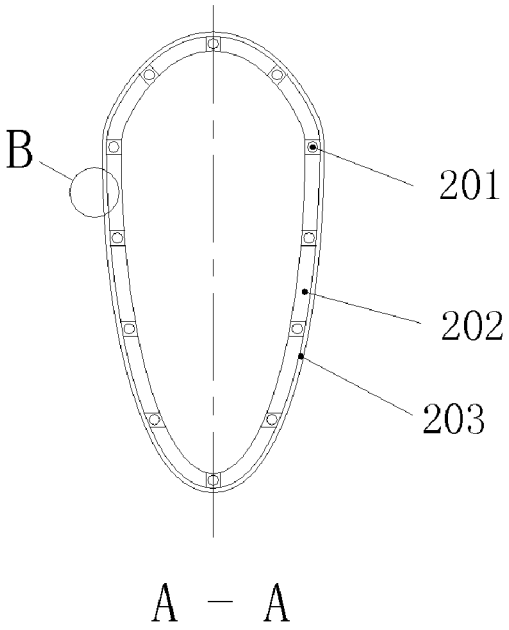
FIG. 4 is a cross-sectional view of FIG. 3 along A-A line.
Figure 5:
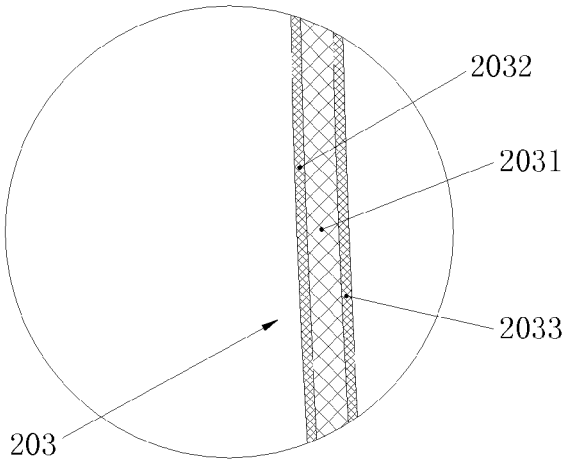
FIG. 5 is a partially enlarged view of portion B of FIG. 4.

FIGS. 3-5 illustrate a second exemplary embodiment of the present invention.

An ornamental light 200 includes a plurality of illuminants 201, a fish-shaped support frame 202 and a film 203 which covers the outside surface of the fish-shaped support frame 202. The film 203 includes a transparent base plate 2031 and two polychrome films 2032, 2033. Each of the polychrome film 2032, 2033 is stuck to each side of the base plate 2031 respectively and has a plurality of venations in a parallel manner. The venations of the polychrome film 2032 disposed on one side of the base plate 2031 are vertical to those of the polychrome film 2033 disposed on the other side of the base plate 2031. As a part of the support frame 202, many illuminants 201 are directly formed on the support frame 202. The shape formed by the luminous illuminants 201 looks like a fish, which is the same with the shape of the support frame 202. In this embodiment of the invention, each illuminant 201 is an LED (light-emitting diode) light. The conducting wires of the LED light are located in the cavity of the support frame 202. A French grey paint layer is coated on the side not touching the base plate 2031 of each polychrome film 2032, 2033. The color is deeper on the fish-backside and fish-head of the support frame and is lighter on the fish-abdomen thereof.

According to the embodiment of the present invention, a layer of special film is provided to cover the outside surface of the fish-shaped support frame of the ornamental light. The film includes a transparent base plate and two polychrome films. Each of the polychrome film is attached to each side of the base plate respectively. The venations of the two polychrome films are perpendicular to each other. Polychrome effect will be shown when the beam of the bulb refracts from cavity of the support frame through the polychrome films. Coating paint on the outside surface of the polychrome films makes the ornamental light more vivid. Since the venations of one polychrome film disposed on one side of the base plate is perpendicular to those of another polychrome film disposed on the other side thereof, the ornamental light presents different polychrome display effect, and enough imagination and aesthetic feeling when viewed from different angles.

Figure 6:
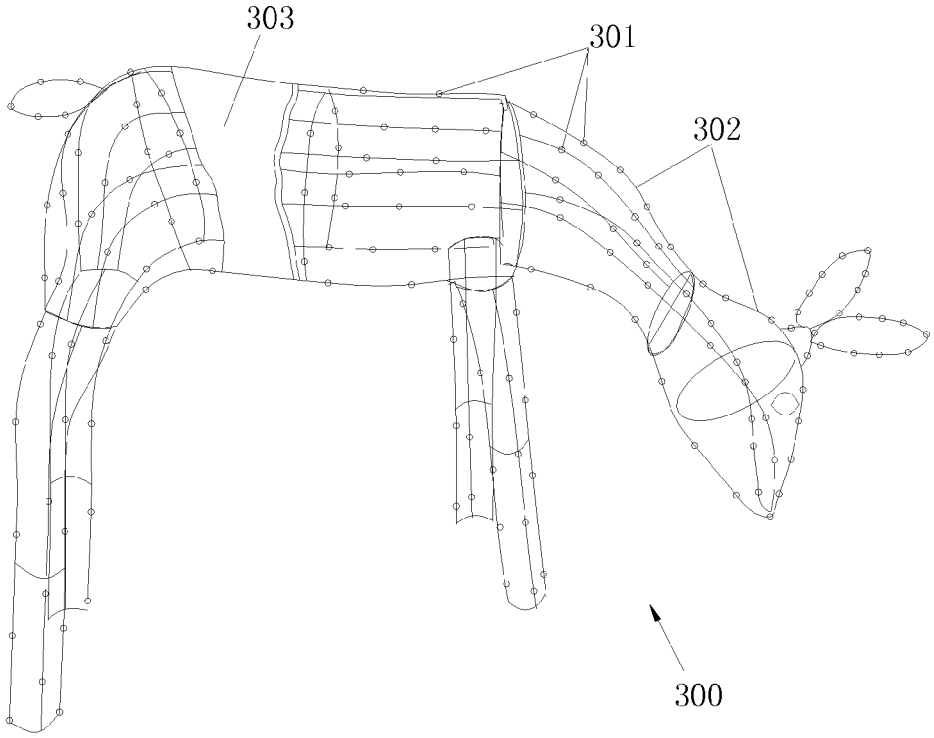
FIG. 6 is a schematic view of a third embodiment of the present invention.

FIG. 6 illustrates a third exemplary embodiment of the present invention.

An ornamental light 300 includes a plurality of illuminants 301, a deer-shaped support frame 302 and a film 303. The film 303 covers the outside surface of the deer-shaped support frame 302. The film 303 includes a transparent base plate and two polychrome films. Each of the polychrome film is attached to each side of the base plate respectively and has a plurality of venations defined therein in a parallel manner. The venations of one polychrome film disposed on one side of the base plate are vertical to those of the other polychrome film disposed on the other side thereof. Many illuminants 301 are connected together by conducting wires to constitute strings, and these strings are mounted on the support frame 302 by winding or binding. The shape formed by the entire luminous illuminants 301 looks like a deer, which is the same with the shape of the support frame 302. A layer of multicolor paint is sprayed on the side not touching the base plate of each polychrome film. The color of paint sprayed thereon may vary at different portion of the deer-shaped support frame, and many dapples may be painted on the surface of the deer-shaped support frame with deep color paint.

According to the exemplary embodiment of the present invention, a layer of special film is provided to cover the outside surface of the deer-shaped support frame. The film includes a transparent base plate and two polychrome films. Each of the polychrome film is attached to each side of the base plate respectively. The venations of the two polychrome films are perpendicular to each other. Polychrome effect will be demonstrated when the beam of the bulb refracts from the cavity of the support frame through the polychrome films. Spraying paint on the outside surface of the polychrome films makes the shape of the ornamental light more vivid. Since the venations of each polychrome film is perpendicular to each other, the ornamental light presents different polychrome display effect, and brings enough imagination and aesthetic feeling when viewed from different angles.

Figure 7:
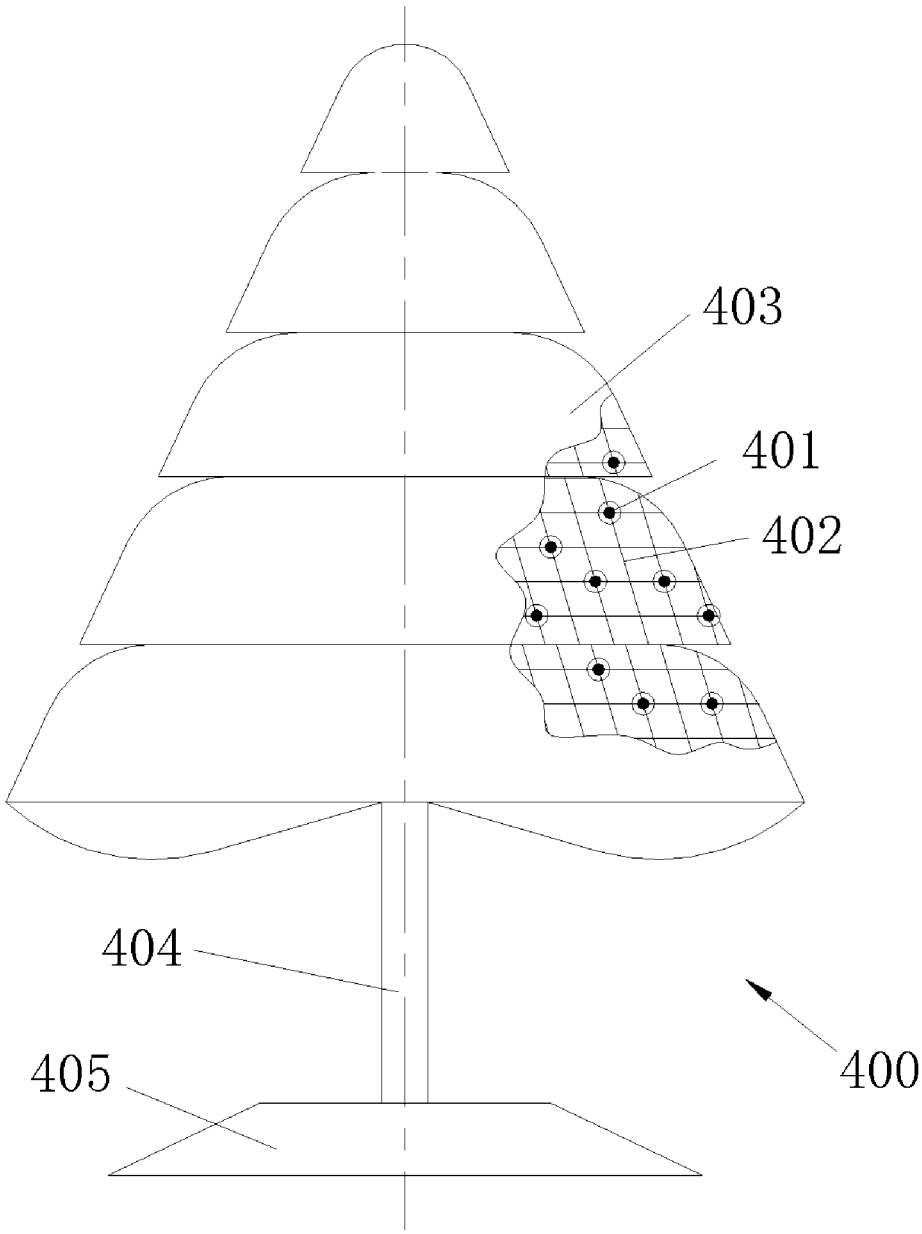
FIG. 7 is a schematic view of a fourth embodiment of the present invention.

FIG. 7 illustrates a fourth exemplary embodiment of the present invention.

An ornamental light 400 includes a plurality of illuminants 401, a tree-shaped support frame 402 and a film 403. The film 403 covers the outside surface of the tree-shaped support frame 402 and, more particularly, it covers the branches and leaves of the support frame 402, but doesn't cover a base 405 and a lower trunk 404. The film 403 includes a transparent base plate and two polychrome films. Each of the polychrome film is attached to each side of the base plate respectively and has a plurality of venations defined therein in a parallel manner. The angle between the venations of one polychrome film disposed on one side of the base plate and those of another polychrome film disposed on the other side thereof is 30°. Many illuminants 401 are connected together to construct strings and these strings are mounted on the support frame 402 by winding or binding. The shape formed by the entire luminous illuminants 401 looks like a tree, as that of the support frame 402.

According to the exemplary embodiment of the present invention, a layer of special film is provided to cover the outside of the tree-shaped support frame of the ornamental light. The film includes a transparent base plate and two polychrome films. Each of the polychrome film is attached to each side of the base plate respectively. The venations of one polychrome film are in cross with those of the other polychrome film. Polychrome effect will be presented when the beam of the bulb is refracted from cavity of the support frame through the polychrome films. Because the angle, which is formed between the venations of one polychrome film disposed on one side of the base plate and those of another polychrome film disposed on the other side thereof, is 30°, the ornamental light has different polychrome display effect, enough imagination and aesthetic feeling when viewed from different angles.

What is claimed is:

1. An ornamental light, comprising:

at least one illuminant;

a support frame with a special shape;

a film covered on the surface of the support frame;

the film comprises a transparent base plate and two polychrome films, and each of the polychrome film is stuck to each side of the base plate; and the polychrome film has multicolor paint coated thereon and has a plurality of venations defined therein in a parallel manner, the venations of one polychrome film disposed on one side of the base plate are in cross with those of the other polychrome film disposed on the other side of the base plate.

2. The ornamental light according to claim 1, wherein the venations of one polychrome film disposed on one side of the base plate are perpendicular to those of the other polychrome film disposed on the other side of the base plate.

3. The ornamental light according to claim 1, wherein the base plate is a colorless and transparent.

4. The ornamental light according to claim 1, wherein the shape of the support frame is selected from cylinder, ball, triangular prism, cuboid, pentagonal prism, hexagonal prism, octagonal prism, decagonal prism and dodecagonal prism.

5. The ornamental light according to claim 1, wherein the support frame has a shape of animal.

6. The ornamental light according to claim 1, wherein the shape of the support frame is selected from rat, cow, tiger, rabbit, dragon, snake, horse, sheep, monkey, chicken, dog, pig, deer, bird, fish, duck, goose, elephant, lion, tree and banana.

7. The ornamental light according to claim 1, wherein the support frame is disposed to surround the illuminants which are located in a cavity of the support frame.

8. The ornamental light according to claim 1, wherein the illuminants are mounted on the support frame and the shape of the entire illuminants is the same as that of the support frame.

* * * * *